US006845896B2

(12) United States Patent
Kral

(10) Patent No.: US 6,845,896 B2
(45) Date of Patent: Jan. 25, 2005

(54) EXPULSION DEVICE ACTUATED BY A PRESSURE MEDIUM

(75) Inventor: Gerhard Kral, Schotten (DE)

(73) Assignee: PREBENA Wilfried Bornemann GmbH & Co. KG, Schotten (DE)

( * ) Notice: Subject to any disclaimer, the term of this patent is extended or adjusted under 35 U.S.C. 154(b) by 0 days.

(21) Appl. No.: 10/362,952

(22) PCT Filed: Jun. 17, 2002

(86) PCT No.: PCT/EP02/06657

§ 371 (c)(1),
(2), (4) Date: Feb. 26, 2003

(87) PCT Pub. No.: WO03/002308

PCT Pub. Date: Jan. 9, 2003

(65) Prior Publication Data

US 2003/0173393 A1 Sep. 18, 2003

(30) Foreign Application Priority Data

Jun. 28, 2001 (DE) ..... 201 10 754 U

(51) Int. Cl.[7] ..... B25C 5/13
(52) U.S. Cl. ..... 227/130
(58) Field of Search ..... 227/7, 130; 173/13, 173/14, 169, 170, 200; 60/542

(56) References Cited

U.S. PATENT DOCUMENTS

| | | | | | |
|---|---|---|---|---|---|
| 3,583,496 | A | * | 6/1971 | Fehrs | 173/15 |
| 3,815,475 | A | * | 6/1974 | Howard et al. | 91/399 |
| 3,850,079 | A | * | 11/1974 | Fehrs | 91/308 |
| 3,871,566 | A | * | 3/1975 | Elliesen et al. | 227/130 |
| 4,380,313 | A | * | 4/1983 | Klaus et al. | 227/130 |
| 4,688,645 | A | * | 8/1987 | Muller | 173/200 |
| 5,437,339 | A | * | 8/1995 | Tanaka | 173/210 |

FOREIGN PATENT DOCUMENTS

| | | |
|---|---|---|
| DE | 33 09 226 | 9/1984 |
| EP | 0 191 186 | 8/1986 |

* cited by examiner

*Primary Examiner*—Scott A. Smith
*Assistant Examiner*—Nathaniel Chukwurah
(74) *Attorney, Agent, or Firm*—Flynn, Thiel, Boutell & Tanis, P.C.

(57) ABSTRACT

An expulsion device expels objects or liquid materials from a reservoir using a drive piston which is subjected to the action of a pressure medium. The expulsion device includes a pressure medium container that is exchangeable and connected to a device body. An actuation device enables the pressure medium to act on the drive piston which is thus displaced in a forward and a backward direction.

11 Claims, 4 Drawing Sheets

EXPULSION DEVICE ACTUATED BY A PRESSURE MEDIUM

FIELD OF INVENTION

The present invention relates to an expulsion device actuated by a pressure medium for expelling objects or liquid materials from a reservoir by means of a drive piston, subjected to the action of a pressure medium, comprising a pressure medium container, which is exchangeable and connected to a device body enabling the pressure medium to act on the drive piston.

BACKGROUND OF THE INVENTION

A device of the type set out above embodied as an driving device for driving in mechanical fastening means, such as, for example, staples, is known from EP 0 191 186 A2. In the known device a device body is fitted with a pressure medium container, which, when actuated by means of a valve system, serves to exert pressure on a piston, which is connected to an impact ram. In the known expulsion device the pressure medium container is in the form of a $CO_2$ cartridge, the filling pressure of which acts on the piston connected to the impact ram when an actuating device is operated, thereby bringing about a forward movement of the impact ram. In order to implement a return movement of the piston, so as to move the impact ram back into its initial position for repeating the expulsion procedure, the piston is returned to its initial position by means of a mechanical carrier device.

As a result of the mechanically brought about return of the piston into the initial position, only relatively low expulsion frequencies are possible with the known expulsion device. Furthermore, returning the piston into the initial position assumes the application of a corresponding manual force. Overall in this way only a relative low stapling output is possible.

The aim of the present invention is therefore to permit an increase in the expulsion frequency with an expulsion device which is fitted with an exchangeable pressure medium container and can therefore be operated independently of the mains.

SUMMARY OF THE INVENTION

In the expulsion device according to the invention the action of the pressure medium serves both to implement a forward movement and to implement a backward movement of the drive piston, so that in contrast to manually actuated return, a much faster backward movement is achieved. This results in considerably shortened cycle times for the return of the piston, so that overall a clear increase in the expulsion frequency is made possible.

A further increase in the efficiency of the expulsion device can be achieved if the device body of the expulsion device has pressure chamber, separated from the pressure medium container by means of a pressure-reducing device, for subjecting the drive piston to the action of a pressure medium with an operating pressure that is lower than the filling pressure of the pressure medium container. Through the intermediate arrangement of the pressure-reducing device the filling pressure in the pressure medium container can be increased to many times the operating pressure so that a considerably increase in the operating time of the expulsion device is achieved before it becomes necessary to exchange the pressure medium container.

If, in order to initiate the action of the pressure medium on the drive piston an actuating device is provided, which at the same time serves to operate a ventilation valve arrangement for ventilating a drive cylinder accommodating the drive piston, a synchronization between the pressure medium action and control of the ventilation valve arrangement is achieved in a simple manner. A particularly direct form of mechanical implementation of this synchronisation, and thereby also particularly short operating cycles of the expulsion device, become possible if the ventilation valve is connected to the actuating device by means of a ram device.

In a particularly preferred form of embodiment of the expulsion device the ventilation valve arrangement is designed as a piston valve with a valve axis intersecting the piston cylinder axis. On the one hand, by embodying the valve arrangement as a piston valve very high hysteresis figures can be achieved for the valve arrangement. On the other hand with the valve arrangement intersecting the drive cylinder axis particularly effective and thus rapid ventilation of the drive cylinder over the cylinder base is permitted.

If the drive piston simultaneously serves as a control piston for carrying out the pressure-actuated backward movement of the drive piston in the piston cylinder, the structural implementation of pressure medium-actuated drive piston return is made possible with particularly few mechanical components because of the functionally integrated effect of the drive piston. In terms of further simplified structural assembly, it also proved to be advantageous if the expulsion end of the drive cylinder is surrounded by a ring chamber with an inflow system, arranged at a distance from the end cross-section of the piston displacement of the drive cylinder, and an outflow system arranged in the area of the end-cross-section and merging into the piston displacement area, whereby the distance between the inflow system and the outflow system corresponds at least to the axial extent of the drive piston.

A further increase in the efficiency of use of the pressure potential provided by the pressure medium container is possible if the drive cylinder has, at its expulsion end, a cylinder base with a ram opening for a drive ram connected to the drive piston, with a radial sealing device arranged in the ram opening. This allows largely pressure medium-tight sealing of the annular gap between the drive ram and the drive opening necessary for the relative movement of the drive ram, so that leakage through the annular gap can be largely prevented. If, in addition, the sealing device is arranged in the cylinder base, any embodiment of the sealing seat is possible, irrespective of an influence of the drive ram cross-section.

Depending on the type and design of the container provided for combination with the expulsion device, it is possible to use the expulsion device according to the invention for expelling objects, i.e. solid bodies, or also fluid materials.

If, in accordance with a particularly advantageous form of embodiment of the expulsion device the container is designed as a magazine device for holding mechanical fastening means, and the drive ram serves to strike an individual fastening means arranged in a feeder channel arranged on the magazine device, the expulsion device can particularly advantageously be used as a nailing device.

In a further advantageous form of embodiment of the expulsion device the container is designed as a liquid reservoir, and the drive ram exerts a pressure on quantity of liquid in a dispensing system arranged on the liquid reservoir. This quantity of liquid can, for example, be a liquid paint, which is expelled in dosed quantities to produce coloured dots for instance. It is also possible to dispense quantities of adhesive, for producing adhesive dots for example.

An advantageous from of embodiment of the expulsion device will be described below with the aid of the drawings, in which:

DETAILED DESCRIPTION

Figure 1:
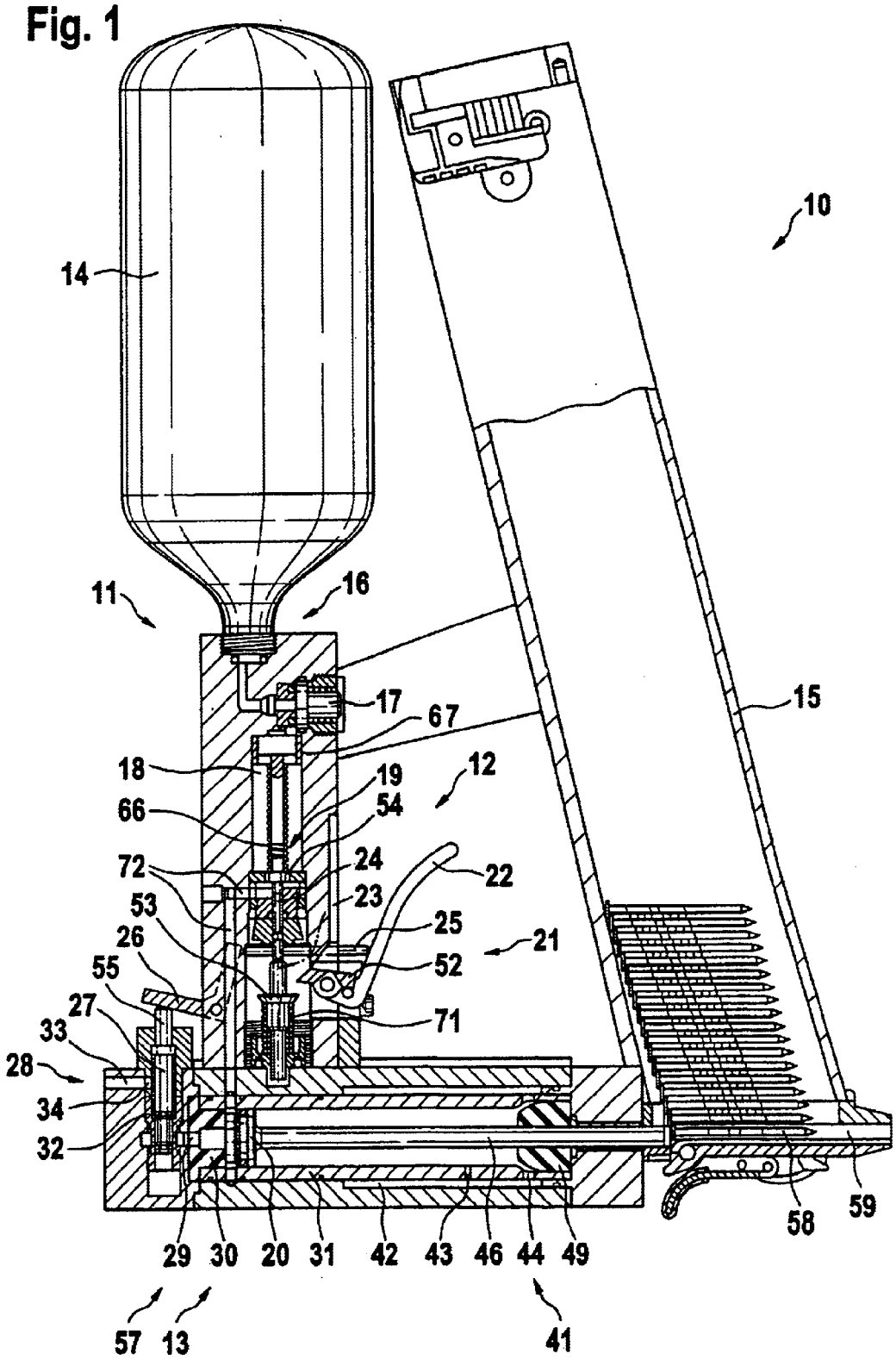
FIG. 1 shows a lateral view of the expulsion device with a drive piston/cylinder unit in partial cross-section.

FIG. 1 shows a lateral view of an overall drawing of an expulsion device 10. The expulsion device 10 comprises a device body 13, with a grip section 12 and a drive piston/cylinder unit 13, whereby a pressure medium container 14 for storing compressed gas is connected to the grip section 12 and a container designed here as a magazine device 15 is connected to the drive piston/cylinder unit 13.

At its end turned away from the drive piston/cylinder unit 13, the grip section 12 is connected in a detachable manner to the pressure medium container 14 via a coupling device 16, which can, for example, be in the form of a screw-in thread. To set an operating pressure for the drive piston/cylinder unit 13, which is independent of a filling pressure in the pressure medium container 14, a separate pressure chamber 18 is provided in the grip section 12 separated from the pressure medium container 14 by means of a pressure reducing device 17.

Between the pressure chamber 18 and the drive piston/cylinder unit 13 there is arranged a tilling valve device 19 for subjecting a drive piston 20 of the drive piston/cylinder unit 13 to the operating pressure by way of operating the filling valve device 19 with an actuating device 21. The filling valve device 19 has a sealing element 67, pretensioned by a valve spring 66 in the direction of the valve opening, which is pressed against a valve opening 54 for the purpose of sealing by a valve ram 24 subject to the action of a closing spring 71. As can be seen in FIG. 1 a starting lever 22 of the actuating device 21 is mechanically connected via a ram rod 25 running perpendicularly to a valve axis 23 of the filling valve device 19 and a pivoting lever 26 in the grip section 12 to valve piston 27 of a ventilating valve arrangement 28.

Figure 2:
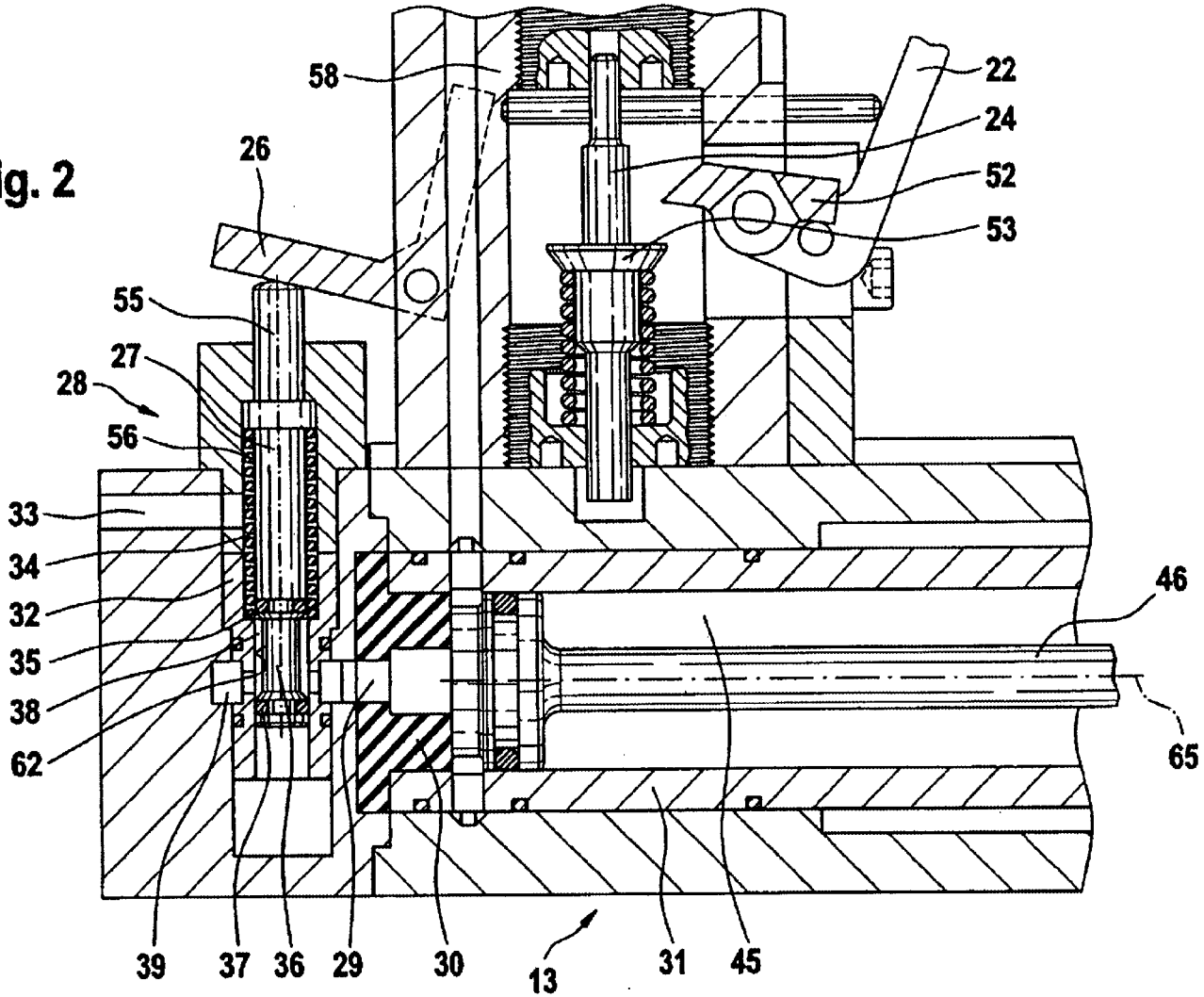
FIG. 2 shows an enlargement of the control valve arrangement which interacts with the drive piston/cylinder unit

As can be seen particularly from the enlargement in accordance with FIG. 2, there is a ventilation valve arrangement 28 for the release and/or closing of a ventilation opening. 29 in a first cylinder base 30 of a drive cylinder 31 of the drive piston/cylinder unit 13 arranged adjacent to the ventilation valve arrangement 28. The ventilation valve arrangement 28 comprises a valve body 32, which is arranged between the ventilation opening 29 in the cylinder base 30 and a casing ventilation opening 33 in such a way that a valve axis 64 of the ventilation valve arrangement 28 intersects a drive cylinder axis 65 of the drive cylinder 31. Ventilation takes place via valve opening 34 (FIG. 2) of the ventilation valve arrangement 28 provided in the ventilation path, whereby the valve opening 34 simultaneously services to accommodate the valve piston 27. Through-flow of the outgoing air from the drive cylinder 31 through the valve opening 34 is permitted or blocked via a sealing device 35 arranged in a radial manner, in this case in the form of an O-ring, on the valve piston 27, in that the sealing device 35 is moved into and out of a valve opening 62 of the ventilation valve device 28 coaxial to the valve piston 27 by way of an appropriate axial movement. In this case, on the valve spigot 36 of the valve piston 27 there is a radial sealing device 37, also in the form of an O-ring, which in interaction with the first sealing device 35 forms a sealing space 38 in the form of an annular gap, which is fluid-technically connected via radial ring channel device 39 to the ventilation opening 29 of the drive cylinder 31.

Figure 3:
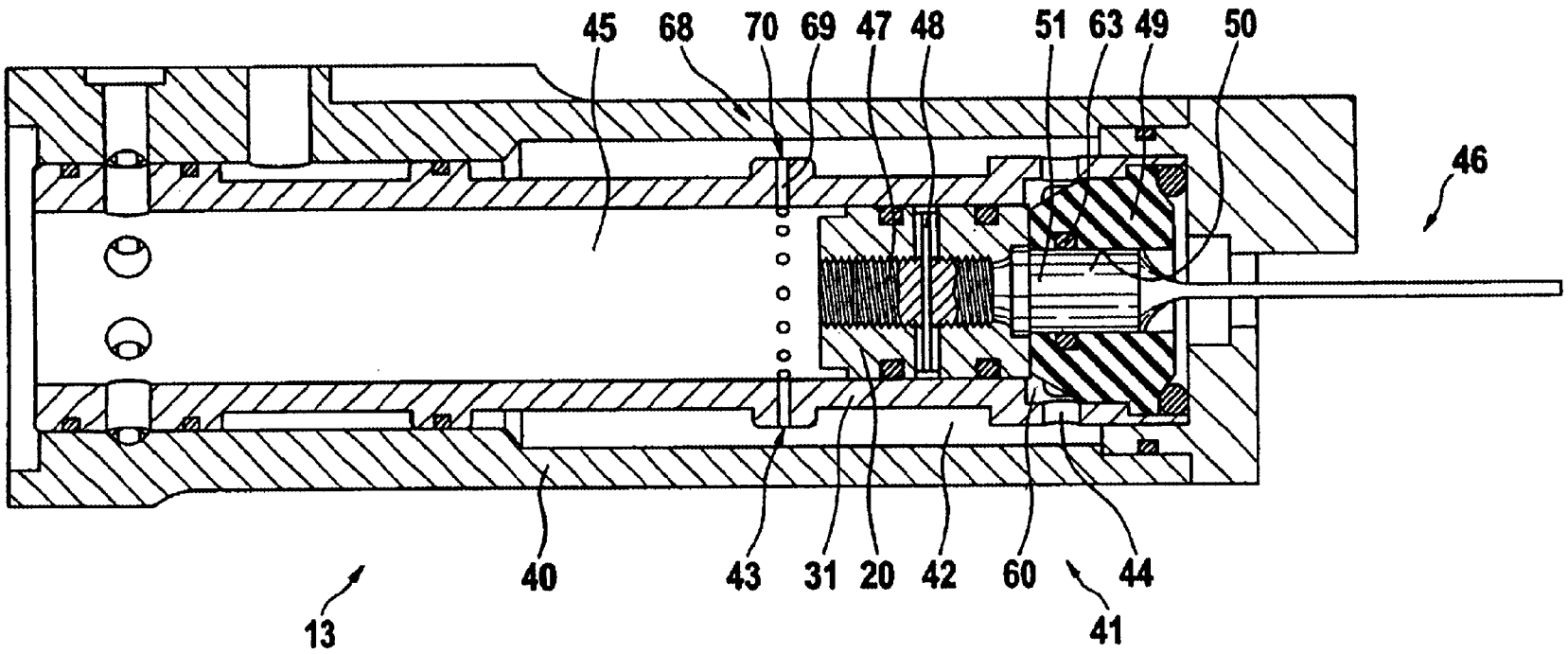
FIG. 3 shows the drive piston/cylinder unit with the drive piston at a relative distance to the expulsion side piston base.
Figure 4:
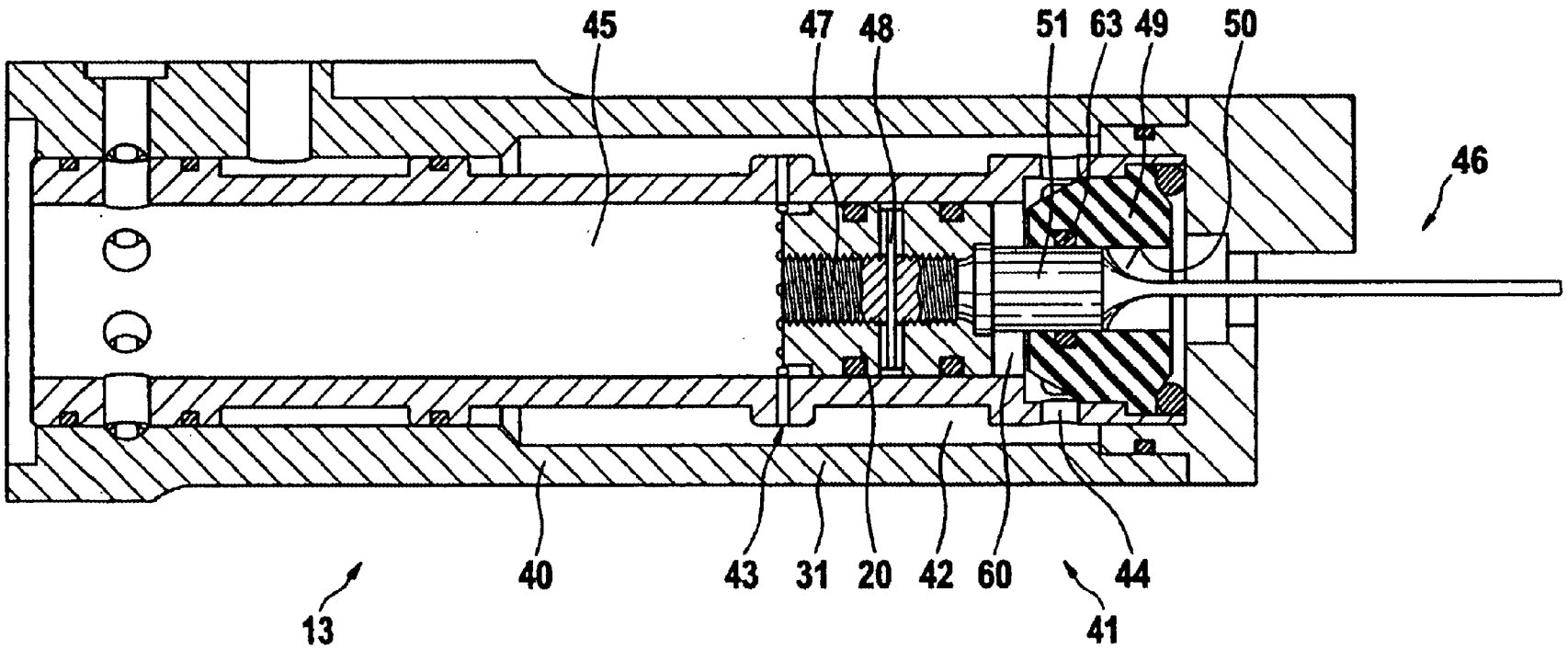
FIG. 4 shows the drive piston/cylinder unit shown in FIG. 3 with the drive piston at a distance relative to the expulsion-side piston base.

As can be seen in FIGS. 3 and 4, in which the drive piston/cylinder unit 13 is shown with two different axial positions of the drive piston 20, the drive piston/cylinder unit 13 has the drive cylinder 31 set into a casing 40, as well as the drive piston 20 which is axially moveable within the drive cylinder 31. As a result of the coaxial arrangement of the drive cylinder 31 in the casing 40, a ring chamber 42 is formed in the area of an expulsion end 41 of the drive piston/cylinder unit 13, which is connected via a first ring channel device 43 provided as an inflow device and a second ring channel device 44 designed as an outflow device to a displacement or lumen 45 of the drive cylinder 31. To bring about a ring channel sealing 68 which is dependent on the pressure direction, the ring channel device 43 on the outer wall of the drive cylinder 31 is provided with an annular groove 69, in which an O-ring seal 70 is arranged in an elastically pre-tensioned manner. The axial distance between the ring channel devices 43 and 44 is selected so that it is at least slightly greater than the axial dimension of the drive piston 20.

In this case the drive piston 20 is designed as a sleeve into which a drive ram 46 is screwed in with a screw-in end 47.

A securing pin 48 serves to prevent twisting between the screw-in end 47 of the drive ram 46 and the drive piston 20.

At the expulsion end of the drive cylinder 31 a second cylinder base 49 is arranged which is provided with a ram opening 50, into which the drive ram 46 engages with a sealing collar 51 when the drive piston 20 is positioned in the area of the expulsion end 41. To seal the ram opening 50 a radial sealing device 63, in this case in the form of an O-ring, is provided in the ram opening 50 and is in contacts with the drive ram 46 forming a seal in the axial positions of the drive piston shown in FIGS. 3 and 4. To dampen an impact of the drive piston 20 on the cylinder bases 30 (FIGS. 1 and 2) and 49 during the operation of the expulsion device 10, the cylinder bases 30 and 49 are made of an elastomer material in the present case.

Described below is an operating cycle of the expulsion device 10, covering an axial forward movement of the drive piston 20 up to contact with the cylinder base 49 arranged at the expulsion end 41 and a backward movement of the drive piston 20 up to contact with the cylinder base 30 (FIG. 1) arranged on the outgoing air side adjacent to the ventilation opening 29 of the drive cylinder 31.

To operate the expulsion device 10 with an axial forward movement of the drive piston 20, the starting lever 22 is moved so that the ram rod 25 is moved against the pivoting lever 26. The lever 26 then acts on a ram end 55 of the valve piston 27 of the ventilation valve arrangement 28 and, counteracting the effect of a readjusting spring 56 (FIG. 2), axially moves the valve piston 27 forward to seal the ventilation opening 29. With increasing deflection of the starting lever 22, a carrier catch 52 arranged in an articulated manner on the starting lever 22 contacts an annular beading 53 of the valve ram 24 and the valve opening 54 (FIG. 1) at the lower end of the pressure chamber 18 is released, so that with a sealed ventilation opening 29 of the drive cylinder is filled with the gas at operating pressure via a pressure pipeline 58, extending from the valve opening 54 of the pressure chamber 18 to the ventilation end 57 of the drive cylinder 31, which merges in a radial manner into the displacement 45 of the drive cylinder 31.

As a result of the pressure filling of the drive cylinder 31, the drive piston along with the drive ram 46 arranged on it is axially accelerated until it comes into contact against the cylinder base 49 arranged at the expulsion end 41 (FIGS. 4 and 5). As the carrier contact between the carrier catch 52 and the annular beading 53 on the valve ram 24 of the filling valve arrangement 19 is designed in such a way that there is a roll-off contact between the carrier catch 52 and the annular beading 53 when the starting lever 22 is operated, after a predetermined movement path of the starting lever 22 the annular beading engaged by the carrier catch 52 is released again and the valve opening 54 of the pressure chamber 18 is closed again by the closing spring-actuated valve ram 24.

The drive ram 46 exerts an impact on a steel pin 58 arranged in a feeder channel 59 at the lower end of the magazine device 15 which pushes the individual steel pin 58 in the feeder channel 59 out of the feeder channel 59 and into a material arranged in front of the feeder channel.

When the drive piston 20 is in its impact position on the expulsion side, as shown in FIG. 3, the ring channel device 43 acting as the inflow device is released so that the gas can, with the ring channel seal 68 open, flow under pressure out of the displacement 45 of the drive cylinder 31 into the ring chamber 42, and from here through the ring channel device 44 designed as an outflow device into an annular gap 60 in the drive cylinder between the drive piston 20 and the cylinder base 49 on resetting the starting lever 22 though the action of the readjustment spring 34, the ventilation opening 29 is released again so that the pressure acting in the annular gap 60 can bring about the backward movement of the drive piston 20 in the direction of the cylinder base 30 at the ventilation end 57 (FIGS. 1 and 2) of the drive cylinder 31. When the starting lever 22 is returned to its initial position the articulated carrier catch 52 is pivoted away from contact with the annular beading 53.

As can be seen from FIGS. 3 and 4, the sealing device 63 in the ram opening 50 largely prevents leakage from the annular gap 60 when pressure is exerted on the drive piston 20 in order to bring about a backward movement. In order, as shown in FIG. 4, to ensure that the drive piston 20 is returned even in the event of the drive piston 20 not coming into contact with the cylinder base 49, the distance between the ring channel device 43 acting as an inflow device and the cylinder base 49 is greater than the axial dimension of the drive piston 20. The drive piston 20 may not strike the cylinder base 49 as a result of too great a material resistance when driving a steel pin 58 arranged in the feeder channel 59 into a material, for example a knot area in a board being nailed.

REFERENCE LIST

10. Expulsion device
11. Device body
12. Grip section
13. Drive piston/cylinder unit
14. Pressure medium container
15. Magazine device -continued

REFERENCE LIST

16. Coupling device
17. Pressure reducing device
18. Pressure chamber
19. Filling valve device
20. Drive piston
21. Actuating device
22. Starting lever
23. Valve axis
24. Valve ram
25. Ram rod
26. Pivoting lever
27. Valve piston
28. Ventilation valve arrangement
29. Ventilation opening
30. Cylinder base
31. Drive cylinder
32. Valve body
33. Casing ventilation opening
34. Valve opening
35. Sealing device
36. Sealing spigot
37. Sealing device
38. Sealing space
39. Ring channel device
40. Casing
41. Expulsion end
42. Ring chamber
43. Ring channel device
44. Ring channel device
45. Displacement
46. Drive ram
47. Screw-in end
48. Securing pin
49. Cylinder base
50. Ram opening
51. Seal collar
52. Carrier catch
53. Annular beading
54. Valve opening
55. Ram end
56. Readjustment spring
57. Ventilation end
58. Steel pin
59. Feeder channel
60. Annular gap
61. Readjustment spring
62. Valve opening
63. Sealing device
64. Valve axis
65. Drive cylinder axis
66. Valve spring
67. Sealing element
68. Ring channel seal
69. Radial groove
70. O-ring seal
71. Closing spring

What is claimed is:

1. An expulsion device actuated by a pressure medium for expelling one of objects and liquid materials from a reservoir comprising:

a device body;

a pressure medium container, which is exchangeable and secured to the device body; and a drive piston selectively driven by the pressure medium, wherein the action of the pressure medium implements both a forward movement and subsequently a backward movement of the drive piston.

2. The expulsion device according to claim 1, wherein the device body includes a pressure chamber, which is separated from the pressure medium container by a pressuring reducing device, for subjecting the drive piston to the action of an operating pressure that is reduced relative to a filling pressure of the pressure medium container.

3. The expulsion device according to claim 1, including an actuating device to initiate the action of the pressure medium on the drive piston, which simultaneously serves to operate a ventilation valve arrangement for ventilating a drive cylinder accommodating the drive piston.

4. The expulsion device according to claim 3, wherein the ventilation valve arrangement is connected to the actuating device by a ram device.

5. The expulsion device according to claim 3, wherein the ventilation valve arrangement comprises a piston valve with a valve axis intersecting a drive cylinder axis of the drive cylinder.

6. The expulsion device according to claim 1, wherein the reservoir comprises a magazine device for holding mechanical fasteners and a drive ram for exerting an impact on a fastener individually held in a feeder channel of the magazine device.

7. An expulsion device for actuation by a pressure medium to expel one of objects and liquid materials from a reservoir comprising:

a device body;

an exchangeable pressure medium container secured to said device body;

a drive cylinder with a drive piston; and an actuating device for providing a pressure medium from the pressure medium container, wherein the pressure medium implements a forward movement of the drive piston in the drive cylinder and the drive piston simultaneously acts as a control piston to implement a pressure medium-actuated backward movement of the drive piston in the drive cylinder.

8. The expulsion device according to claim 7, wherein the drive cylinder is surrounded at an expulsion end with a ring chamber, an inflow device arranged at a distance from an end cross-section of the displacement of the drive cylinder, and an outflow device arranged in the area of the end cross-section and merging into the displacement, whereby the distance between the inflow device and the outflow device at least corresponds to the axial extent of the drive piston.

9. The expulsion device according to claim 8, wherein at the expulsion end the drive cylinder has a cylinder base with a ram opening for a drive ram connected to the drive piston, and the ram opening is provided with a radial sealing device.

10. The expulsion device according to claim 9, wherein the sealing device is arranged in the cylinder base.

11. An expulsion device actuated by a pressure medium for expelling liquid materials from a liquid reservoir comprising:

a device body;

an exchangeable pressure medium container secured to said device body; and a drive piston and a drive ram secured thereto for exerting a pressure medium on a quantity of liquid contained in a dispensing device arranged on the liquid reservoir, wherein the exerted pressure medium implements both a forward movement and subsequently a backward movement of the drive piston.

* * * * *